US007309214B2

(12) United States Patent
Bachofner et al.

(10) Patent No.: US 7,309,214 B2
(45) Date of Patent: Dec. 18, 2007

(54) ROTOR END PIECE

(75) Inventors: René Bachofner, Untersiggenthal (CH); Wolfgang Kappis, Fislisbach (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 11/530,308

(22) Filed: Sep. 8, 2006

(65) Prior Publication Data

US 2007/0041840 A1 Feb. 22, 2007

Related U.S. Application Data

(63) Continuation of application No. PCT/EP05/50839, filed on Feb. 28, 2005.

(30) Foreign Application Priority Data

Mar. 8, 2004 (DE) ..... 10 2004 011 508

(51) Int. Cl.
*F01D 5/32* (2006.01)

(52) U.S. Cl. ..... 416/215; 416/220 R; 416/204 A

(58) Field of Classification Search ..... 416/213 R, 416/215, 219 R, 220 R, 204 A; 29/889.21
See application file for complete search history.

(56) References Cited

U.S. PATENT DOCUMENTS 2,917,274 A 12/1959 Davidson et al.
6,299,411 B1 * 10/2001 Freuschle et al. ..... 416/215
6,778,191 B2 8/2004 Diederiks et al.
6,929,453 B2 * 8/2005 Kite et al. ..... 416/220 R
7,114,927 B2 * 10/2006 Bachofner et al. ..... 416/213 R

FOREIGN PATENT DOCUMENTS

| | | |
|---|---|---|
| DE | 812337 | 8/1951 |
| DE | 1019318 | 11/1957 |
| DE | 1128864 | 5/1962 |
| DE | 2002469 | 7/1971 |
| EP | 1028231 | 8/2000 |
| FR | 1068776 | 6/1954 |
| GB | 849124 | 9/1960 |
| GB | 1388668 A * | 3/1975 |

OTHER PUBLICATIONS

Brief translation of German Search Report, 10 2004 011 508.7, mailed Jul. 26, 2004.

* cited by examiner

*Primary Examiner*—Ninh H. Nguyen
(74) *Attorney, Agent, or Firm*—Darby & Darby

(57) ABSTRACT

A rotor end piece for a rotor of a thermal turbomachine having a circumferential slot includes two end piece halves having side faces opposite one another in the installed state and top surfaces adjoining one another, the side faces of the end piece halves being connected to one another in a form-fitting manner by means of a dovetail interlocking connection, and a whole intermediate end piece having a top surface, the two interlocked end piece halves being firmly connected to the whole intermediate end piece in the region of the top surfaces via a weld.

3 Claims, 3 Drawing Sheets

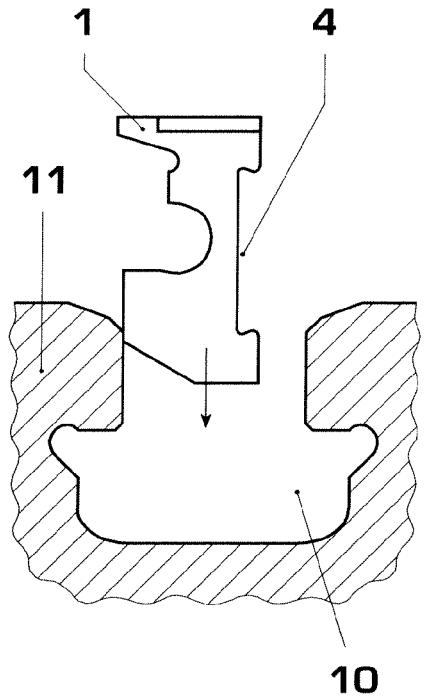
a)
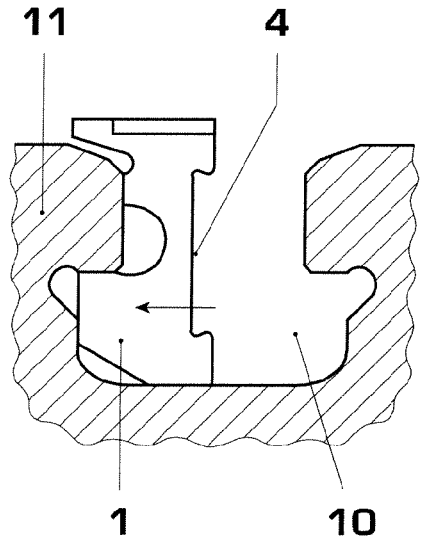
b)
Fig. 3
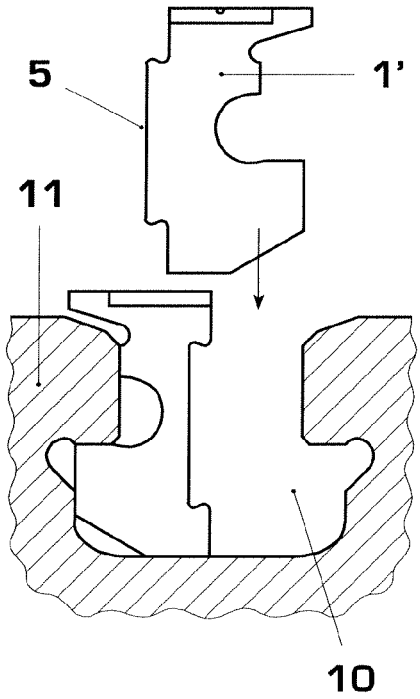
c)
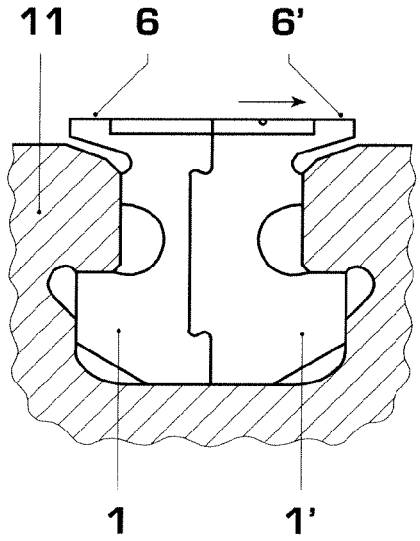
d)

ROTOR END PIECE

This application is a continuation of International Patent Application No. PCT/EP2005/050839, filed Feb. 28, 2005, which claims priority of German Patent Application No. DE 10 2004 011 508.7, filed on Mar. 8, 2004, the entire disclosure of which is incorporated by reference herein.

The present invention relates to the field of power plant technology. It relates to a rotor end piece for rotors of thermal turbomachines and to a method of fitting the rotor end piece.

BACKGROUND

Thermal turbomachines, such as turbines and compressors, generally comprise a rotor fitted with moving blades and a stator in which the guide blades are suspended.

A task of the fixed guide blades is to direct the flow of the gaseous medium to be compressed or expanded onto the rotating moving blades in such a way that the energy conversion is effected with the best possible efficiency.

Both moving blades and guide blades essentially have an airfoil and a blade root. In order to be able to fasten the moving blades on the rotor or the guide blades in the stator, slots are recessed in the stator and on the rotor shaft. The roots of the blades are pushed into these slots and locked there.

It is known in the case of compressor rotors having circumferential slots to alternately fit moving blades and intermediate pieces in the turned rotor groove (circumferential slot) until an opening remains in the circumferential direction, this opening being filled with a "rotor end piece". The rotor end piece consists of an intermediate piece divided in half (two end piece halves) and of a wedge. To fit the intermediate piece divided in half, a residual opening is required, which is finally closed by pushing in a wedge. The two end piece halves each have a straight side face, which at its top end forms a projecting lobe with the top surface of the end piece half. Said side faces are opposite one another in the installed state, the wedge then being located between them. Once the two end piece halves and the wedge have been installed, the lobes of the two end piece halves are finally caulked via the wedge. This known rotor end piece is supported on the rotor.

A disadvantage with this prior art is that the wedge, on account of the tilting moment of the two end piece halves, which is caused by the centrifugal forces during operation, is able to bend open the caulked lobes. The wedge can thus fly out of the compressor and complete compressor damage may occur.

Furthermore, the applicant is familiar with a rotor end piece which is intended for rotors of thermal turbomachines having a circumferential slot and consists of two end piece halves having side faces opposite one another in the installed state and top surfaces adjoining one another and in which the side faces of the end piece halves are connected to one another in a form-fitting manner, to be precise by means of a dovetail interlocking connection known per se. In this case, the two end piece halves are locally welded to one another in the region in which the side faces and the top surfaces of the two end piece halves adjoin one another. This is intended to achieve firm anchoring of the rotor end piece in the installed state. Under high stresses, however, this anchoring is often not sufficient.

SUMMARY OF THE INVENTION

An object of the present invention is to avoid disadvantages of the prior art and to develop a rotor end piece which can be produced and fitted in a simple manner and in which detachment during operation is prevented, so that the occurrence of compressor damage is avoided.

The present invention provides a rotor end piece including two end piece halves and a whole intermediate end piece, the end piece halves being connected to one another in a form-fitting manner by means of a dovetail interlocking connection of the two adjacent end piece halves, and the two interlocked end piece halves being firmly connected to the whole intermediate end piece in the region of the top surfaces via a weld.

The present invention also provides a method of fitting a rotor end piece including the following steps:

a) In a first step, the whole intermediate end piece is fitted in the residual gap.
b) In a second step, the first end piece half is inserted into the circumferential slot of the rotor from above.
c) In a third step, this first end piece half is displaced laterally in the circumferential slot until it is anchored in the rotor.
d) In a fourth step, the second end piece half is fitted next to the already installed first end piece half.
e) In a fifth step, the second end piece half is pushed into the opposite side of the circumferential slot until the first and the second end piece half are interlocked in a form-fitting manner via the dovetail interlocking connection.
f) Finally, in a sixth step, the two end piece halves connected in a form-fitting manner are welded to the whole intermediate end piece in the region of the top surfaces.

Advantages of the invention include the fact that the rotor end piece is anchored in both a form-fitting and an integral manner in the installed state and is therefore anchored firmly. In addition, the individual parts of the rotor end piece according to the invention can be produced in a simple manner and the fitting is not more complicated compared with the known prior art. Detachment during operation is prevented with certainty, so that the occurrence of compressor damage is avoided.

BRIEF DESCRIPTION OF THE DRAWINGS

An exemplary embodiment is shown in the drawings, in which:

FIGS. 3*a–d* show individual steps for fitting the rotor end piece according to the invention in the circumferential slot of the rotor;

DETAILED DESCRIPTION

In each case the same items are provided with the same designations in the figures. The direction of movement of the parts during the installation (FIG. 3) is designated by arrows.

The invention is explained in more detail below with reference to an exemplary embodiment and FIGS. 1 to 5.

Figure 1:
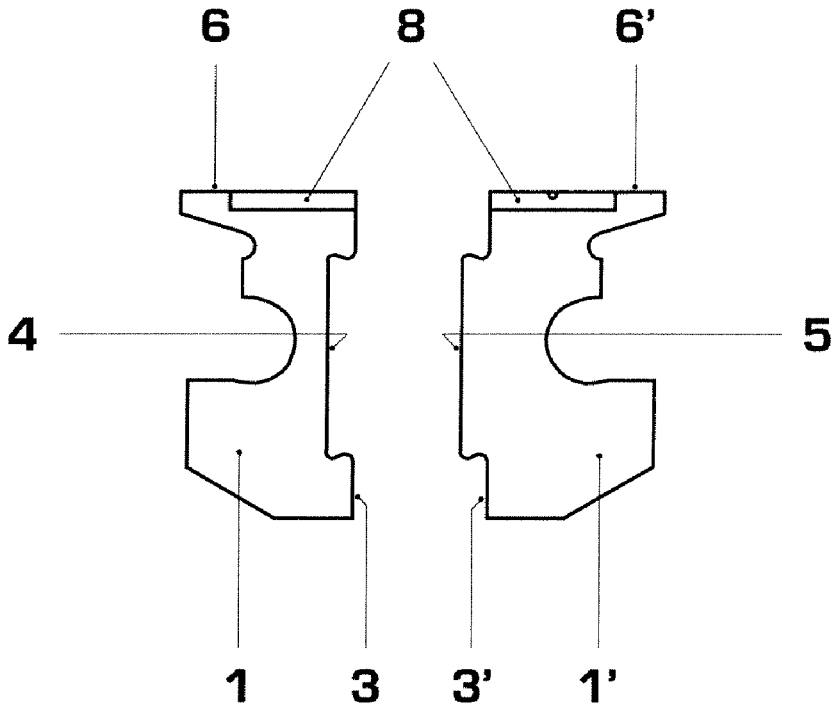
FIG. 1 shows a side view of the two end piece halves with dovetail interlocking connection.
Figure 2:
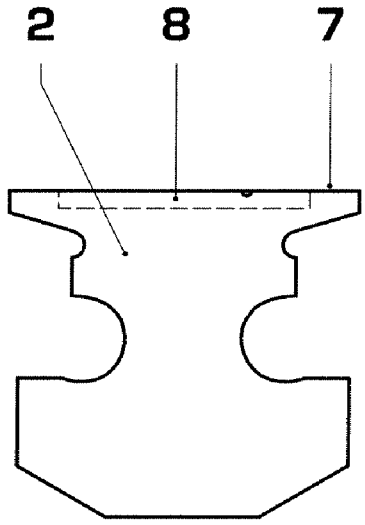
FIG. 2 shows a side view of the whole intermediate end piece with weld preparation.
Figure 4:
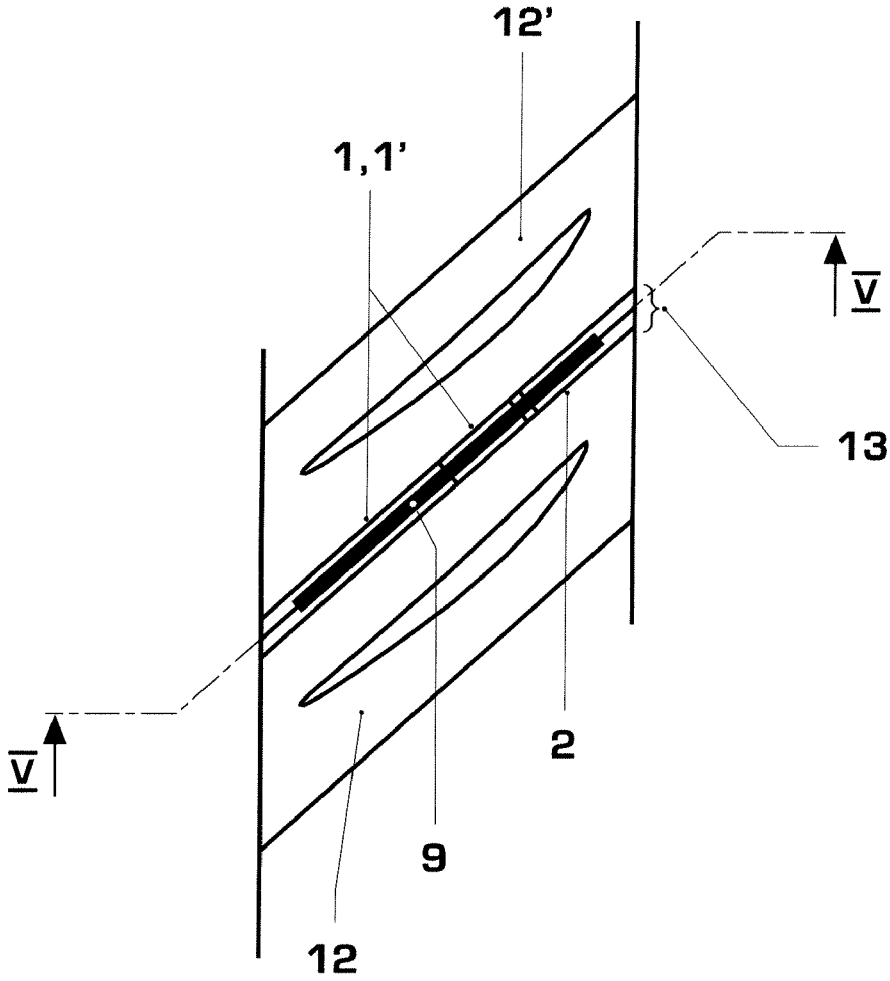
FIG. 4 shows a plan view of two moving blades fitted in the circumferential slot and having the ready fitted and welded rotor end piece according to the invention.
Figure 5:
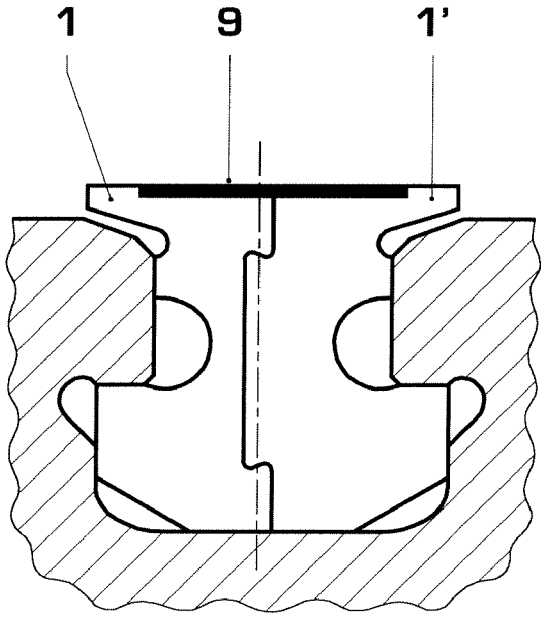
FIG. 5 shows a section along line V—V in FIG. 4.

FIGS. 1 and 2 show the side views of the "individual parts" of a rotor end piece according to the invention for a compressor rotor before the installation; to be precise, FIG. 1 shows the two end piece halves 1, 1' and FIG. 2 shows the whole intermediate end piece 2.

Those side faces 3, 3' of the end piece halves 1, 1' which are opposite one another in the installed state are designed in such a way that they permit a dovetail interlocking connection of the end piece halves 1, 1' which is known per se. To this end, the first end piece half 1 has a recess 4 in the side face 3, whereas the side face 3' of the second end piece half 1' has a projection 5 which fits accurately into this recess 4 (FIG. 1). Joining (interlocking connecting) of the two parts 1 and 1' therefore leads to a form fit (FIG. 3*d*). In order to secure the interlocked end piece halves 1, 1' and the whole intermediate end piece 2 in the installed state, a weld preparation 8 is provided in the region of the top surfaces 6, 6' of the two end piece halves 1, 1' and of the top surface 7 of the intermediate end piece 2, a weld 9 then being produced in this weld preparation 8.

The operation for fitting the rotor end piece is shown in FIGS. 3*a* to 3*d*. First of all, all the moving blades 12, 12', etc., and intermediate pieces are fitted in the circumferential slot 10 of the compressor rotor 11 until a residual opening 13 is obtained, into which only the rotor end piece can be fitted. It is fitted as follows:

In a first step, first of all the whole intermediate end piece 2 is installed in the circumferential slot 10. The first end piece half 1 is inserted into the circumferential slot 10 from above (FIG. 3*a*) and, in a third step, is displaced laterally into the circumferential slot 10 until it is anchored in the rotor 11 (FIG. 3*b*). After that, in a fourth step, the second end piece half 1' is fitted next to the already installed first end piece half 1 (FIG. 3*c*) and, in a fifth step, is pushed into the opposite side of the circumferential slot 10 until the two end piece halves 1, 1' are connected in a form-fitting manner. The two parts 1, 1' are thus interlocked via the dovetail (FIG. 3*d*). Finally, in a sixth step, the two end piece halves 1, 1' connected in a form-fitting manner and the whole intermediate end piece 2 are secured in the region of the top surfaces 6, 6, 7 by means of a weld 9.

The advantages of the invention consist in the fact that the rotor end piece is firmly anchored in a form-fitting and integral manner in the installed state. This anchoring of the rotor end piece prevents detachment during operation and damage to the turbomachine caused as a result. In addition, the individual parts of the rotor end piece according to the invention can be produced in a simple manner, an additional wedge is no longer required, and the fitting is not more complicated compared with the known prior art.

The invention is of course not restricted to the exemplary embodiment described above.

What is claimed is:

1. A rotor end piece for a rotor of a thermal turbomachine having a circumferential slot, the rotor end piece comprising:

two end piece halves disposed in the circumferential slot and each having a first side face opposite one another and each having a first top surface adjoining one another, wherein the first side faces are connected to one another in a form-fitting manner by means of a dovetail interlocking connection in an installed state of the rotor end piece; and a unitary intermediate end piece disposed in the circumferential slot and having a second top surface, wherein the two end piece halves are disposed adjacent to the intermediate end piece and connect to the intermediate end piece at a region of the first and second top surfaces via a weld.

2. A method of fitting a rotor end piece in a residual opening of a circumferential slot of a rotor of a thermal turbomachine, the rotor end piece having a first end piece half having a first top surface, a second end piece half having a second top surface, and a unitary intermediate end piece having a third top surface, the method comprising:

fitting the unitary intermediate end piece in the residual opening;

inserting the first end piece half into the circumferential slot from above;

displacing the first end half piece laterally in the circumferential slot to a first side of the circumferential slot so as to anchor the first end piece half in the rotor;

inserting the second end piece half into the circumferential slot from above adjacent to the first end piece half;

displacing the second end piece half to a second side opposite the first side of the circumferential slot so as to interlock the first end piece half and the second end piece half a in a form-fitting manner;

welding the first and second end piece halves to the unitary intermediate end piece in a region of the first, second and third top surfaces.

3. The method as recited in claim 2, wherein the first and second end piece halves include a dovetail connection and wherein the interlock is accomplished via the dovetail connection.

* * * * *